United States Patent [19]

Grundfest

[11] 4,411,063

[45] Oct. 25, 1983

[54] SPLICE INSTALLING TOOL

[75] Inventor: Michael A. Grundfest, Queens County, N.Y.

[73] Assignee: Thomas & Betts Corporation, Raritan, N.J.

[21] Appl. No.: 260,731

[22] Filed: May 5, 1981

Related U.S. Application Data

[63] Continuation of Ser. No. 55,638, Jul. 9, 1979, abandoned.

[51] Int. Cl.[3] ..... H01R 43/04

[52] U.S. Cl. ..... 29/751; 29/275; 29/760; 29/871; 29/873

[58] Field of Search ..... 29/751, 750, 760, 753, 29/871–873, 275; 72/410

[56] References Cited

U.S. PATENT DOCUMENTS

| | | | |
|---|---|---|---|
| 3,436,820 | 4/1969 | Reem et al. | 72/410 X |
| 3,526,945 | 9/1970 | Ray | 29/212 |
| 3,571,890 | 3/1971 | Brehm et al. | 72/410 X |
| 3,639,977 | 2/1972 | Over | 29/751 X |
| 3,771,208 | 11/1973 | Taylor et al. | 29/753 X |
| 4,019,236 | 4/1977 | Osman | 29/753 |

*Primary Examiner*—Carl E. Hall

*Attorney, Agent, or Firm*—Robert M. Rodrick; Salvatore J. Abbruzzese; Jesse Woldman

[57] ABSTRACT

A tool for simultaneously gripping and positioning a hollow crimping sleeve adjacent a crimping means and retaining two elongate electrical conductors with their bared ends within such hollow sleeve to allow the crimping of such sleeve and conductor ends into a mechanical and electrical joint. A base contains a central sleeve support covered by two separately operable arms, each of which contains a partial sleeve support and cable retaining means. With the sleeve fully supported and the cable positions fixed, the centrally located crimping means is activated by hammering the crimping means or tightening a fastener on a threaded stud.

15 Claims, 14 Drawing Figures

SPLICE INSTALLING TOOL

This is a continuation of application Ser. No. 055,638, filed July 9, 1979, now abandoned.

BACKGROUND OF THE INVENTION

1. Field of the Invention

The invention is directed to the splicing of large-sized conductors in the field where a minimum of space, equipment and time is available.

2. Description of the Prior Art

Present techniques for splicing large-sized conductors in the field provide means only for crimping a metallic crimping sleeve to the bared conductor ends positioned in the sleeve but provide no means for positioning and holding the conductors with respect to the sleeve or tool. The tool, in the form of large pliers, required long handles to minimize the necessary handle force thus placing the operator too far away from the sleeve to control the positions of the bared conductor ends. Also, no provision was made to allow the tool to be closed by means such as a hammer or wrench which could be used in more confined spaces.

SUMMARY OF THE INVENTION

The present invention overcomes the problems noted above with respect to present techniques for splicing large-sized conductors in the field by providing a small installing tool which can be employed in a minimum of space using commonly available wrenches or hammers requiring a minimum of physical strength. The tool provides means to retain the hollow crimping sleeve and the two conductors to be joined in the tool and with respect to the crimping sleeve. Crimping means can now be brought into engagement with the crimping sleeve and operated by means of a threaded stud-fastener arrangement or by striking with a hammer to crimp the sleeve to the bared ends of the conductors placed therein to form a mechanical and electrical joint. It is therefore an object of this invention to provide an improved splice installing tool.

It is another object of this invention to provide a tool for the crimping of a sleeve to the bared ends of conductors retained in said tool.

It is another object of this invention to provide a splice installing tool which can be operated by a wrench.

It is still another object of this invention to provide a splice installing tool which can be operated by a hammer.

It is another object of this invention to provide a splice installing tool which can be operated by a wrench or hammer.

It is yet another object of this invention to provide a splice installing tool which has provision to retain the splice sleeve and conductors therein and fix the positions of the bared ends of the conductors with respect to said splice sleeve.

Other objects and features of the invention will be pointed out in the following descriptions and claims and illustrated in the accompanying drawings, which disclose, by way of example, the principles of the invention and the best modes which have been contemplated for carrying them out.

BRIEF DESCRIPTION OF THE DRAWINGS

In the drawings in which similar elements are given similar reference characters.

DESCRIPTION OF THE PREFERRED EMBODIMENT

Figure 9:
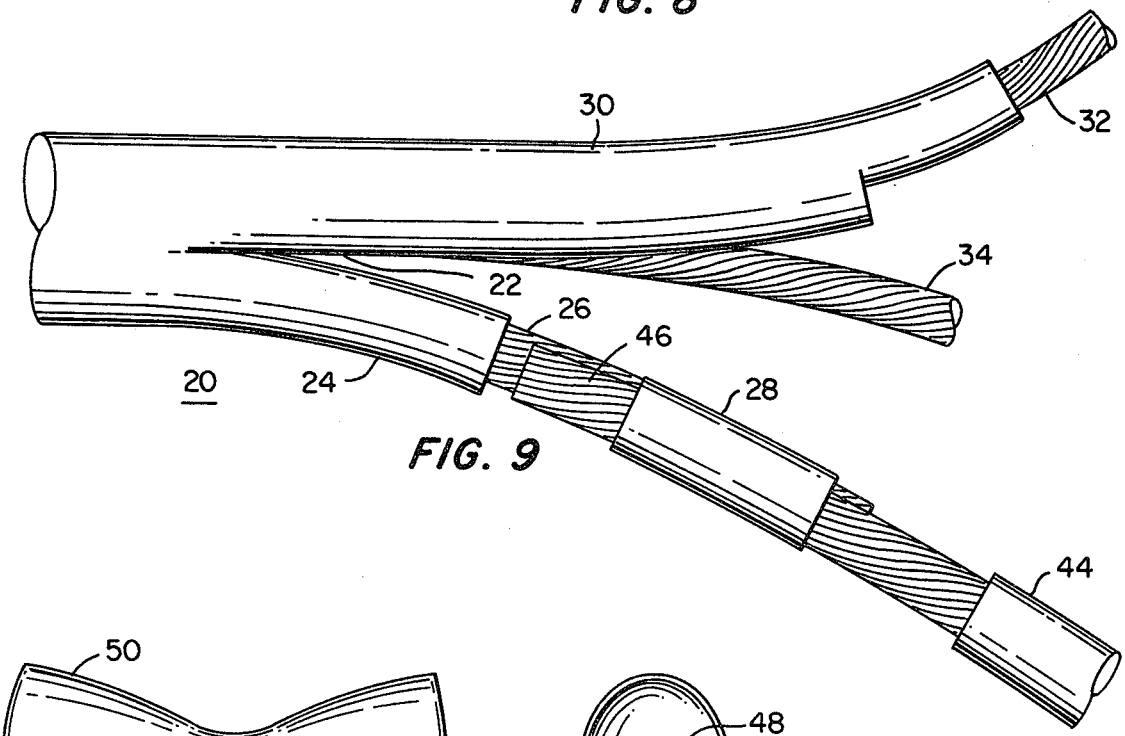
FIG. 9 is a fragmentary top plan view of the electrical conductors to be spliced by the tool of FIG. 1.
Figure 10:
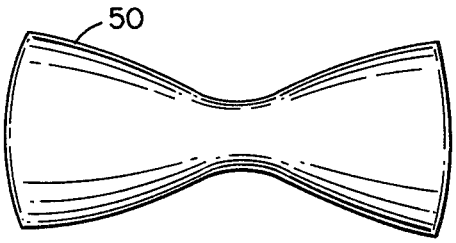
FIG. 10 is a side elevation of a hollow metallic splicing sleeve after same has been crimped in the tool of FIG. 1 with the conductors removed to permit a better appreciation of the sleeve.
Figure 11:
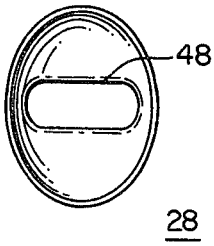
FIG. 11 is an end elevation of the sleeve of FIG. 10.
Figure 12:
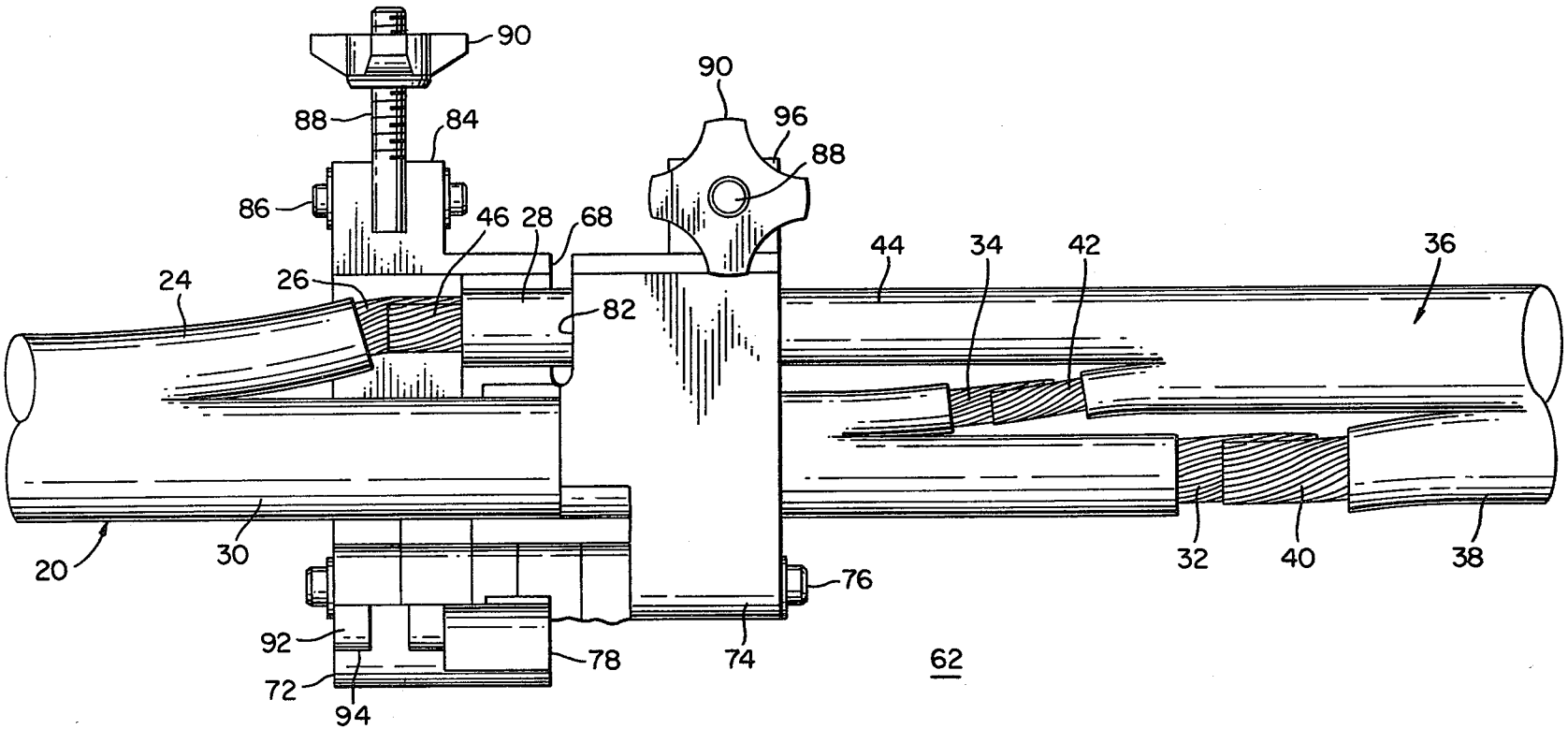
FIG. 12 is a reproduction of the view of FIG. 8 with the conductors of two cables to be spliced placed therein.

Turning now to FIGS. 9 to 11, the conductors of the cables to be spliced and the hollow metallic splicing sleeve can be better appreciated. The cable 20 is a large-sized flexible cable intended to be reeled about a mandrel and therefore even when spliced should be able to conform as closely as possible to the periphery of the rolled cable. To assist in doing this, splices for the individual conductors and ground are staggered so that they will not be one upon another when the cable 20 is reeled up. Cable 20 is cut as at 22 so that conductor 24, still surrounded by insulation, can be separated from the main cable. A portion of conductor 24 is exposed by removing its insulation so that the bared end 26 can be inserted into a hollow metallic crimping sleeve 28. The second conductor 30, longer than conductor 24, also has a bared end 32 which will be inserted within a sleeve (not shown). The ground conductor 34 is cut to an intermediate length so that its crimping sleeve (not shown) will fit intermediate the sleeves for conductors 24, 30 respectively. The cable 36 to be joined to cable 20, as is shown in FIG. 12, is prepared as the inverse of cable 20 having a shorter conductor 38 outside of the tool with bared end 40 to join with bared end 32 of conductor 30, a ground conductor 42 to join with ground conductor 34 of cable 20 and a long conductor 44 with bared end 46 to join with bared end 26 of conductor 24 within sleeve 28. Because of the size of the cables 20, 36 respectively and the need for a staggering of the splice sleeves 28, only one set of conductor ends and one splice sleeve is placed in the installing tool at any one time.

Referring now to FIGS. 10 and 11, the splicing sleeve 28 after crimping same to the bared ends 26, 46 of the conductors 24, 44 respectively is shown with the conductor ends 26, 46 respectively removed. The crimping members, as will be described below in more detail, indent the sleeve 28 uniformly from top and bottom to form an elongate slot 48 at the mid-section of the sleeve 28. The area of slot 48 provides generally optimum crimping for the sleeve 28 and the bared conductor ends 26, 46 to provide a good electrical and mechanical joint therebetween. The ends 50, the sleeve 28 bow outwardly to form a tapered entry into slot area 48 to permit a wider range of movement of the cables 20, 36 respectively as they are reeled and unreeled than would be possible with a completely cylindrical sleeve.

Turning now to FIGS. 1 to 8 and 12 to 14, a splice installing tool 60 constructed in accordance with the concepts of the invention is shown. The tool 60 must have provision for gripping and centering the sleeve 28, for gripping the conductors 24, 44 respectively and holding them in such a position that the bared ends 26, 46 respectively are positioned in and maintained in the sleeve 28 and crimping means that can indent the sleeve 28 to form the slot 48 and which can be operated by means of striking with a hammer or closed by means of a threaded stud-fastener arrangement operated by a wrench.

Specifically referring to FIGS. 6, 7, 8 and 12, the subassembly 62 for gripping sleeve 28 and conductors 24, 44 is shown. A base plate 64 is fitted with a central first sleeve support 66 arranged to partially encompass the periphery and length of a sleeve 28. A slot 68 to admit one indentor of the crimping means bifurcates the support 66. Two arms 72, 74 overlie the base plate 64 and are pivotally coupled thereto as by pin 76. Arm 72 is shown in the open position while arm 74 is in the closed position. Arms 72, 74 respectively have second and third sleeve supports 78, 80 which cooperate with first sleeve support 66 to fully encompass the periphery of a sleeve 28 while generally encompassing the full length of sleeve 28. Arms 72, 74 are provided with relieved areas 82 so that when both are in their closed positions a slot remains for the second indentor of the crimping means to enter to reach sleeve 28 within gripping subassembly 62. Two sets of extensions 84 project from base plate 64 to which is pivotally mounted, as by pins 86, threaded studs 88 upon which are threadedly engaged fasteners 90. Cooperating pairs of extensions 92 on arms 72, 74 (see FIG. 7) receive the threaded studs 88. Fasteners 90 threadedly advanced on the studs 88 and bearing upon the top surfaces 94, 96 of the extensions 92 cause the sleeve 28 to be tightly gripped by the sleeve supports 66, 78 and 80 respectively.

To grip the cable tightly and hold its position so that the bared ends of the conductors are retained within the sleeve 28, the conductor grips 98 and 100 are employed. Conductor grip 98 consists of two sharpened pins arranged to engage the heavy insulation of a conductor 24 a fixed distance from where the bared end 26 enters the sleeve 28. In the event that too much insulation has been removed and none is available to be gripped by the pins of grip 98, the pin of grip 100 can engage the insulation of conductor 30 and maintain the position of conductor 24 in the subassembly 62.

The manner of operation of the gripping subassembly 62 can now be set forth. Firstly, the cables 20, 36 are prepared as shown in FIG. 12 to have one long conductor 30, 44, with bared ends 32, 46 respectively, one short conductor 24, 38 with bared ends 26, 40 respectively and exposed intermediate length ground conductors 34, 42. The bared ends 26, 46 of conductors 24, 44 respectively are placed in sleeve 28 from opposite directions and all are moved to the gripping subassembly 62. The sleeve 28 is placed upon the sleeve support 66 and the ground conductor and conductor 30 of cable 20 pass behind it. Once the position of bared end 46 of conductor 44 is in its correct position in sleeve 28, arm 74 is moved towards base plate 64 causing the grips 98 to engage the insulation of conductor 44 to retain the position of conductor 44 and then for sleeve grip 80 to engage sleeve 28 encompassing it between sleeve grips 66 and 80 respectively. Arm 74 is fixed by advancing fastener 90 on threaded stud 88 which, bearing on surface 96, causes the desired clamping action between base plate 64 and arm 74. Now, the position of the bared end 26 of conductor 24 with respect to sleeve 28 is checked and any necessary adjustments made. The arm 72 is then brought down, further encompassing sleeve 28 between sleeve supports 66 and 78 respectively and fixing the position of conductor 24 by the engagement of grips 98 with the insulation thereof. Arm 72 is similarly locked by fastener 90 bearing upon its surface 94 as it is threadedly advanced along stud 88. The sleeve 28 is now clamped, the conductors 24, 44 are clamped and their bared ends 26, 46 are fixed in the hollow metallic crimping sleeve 28.

Figure 1:
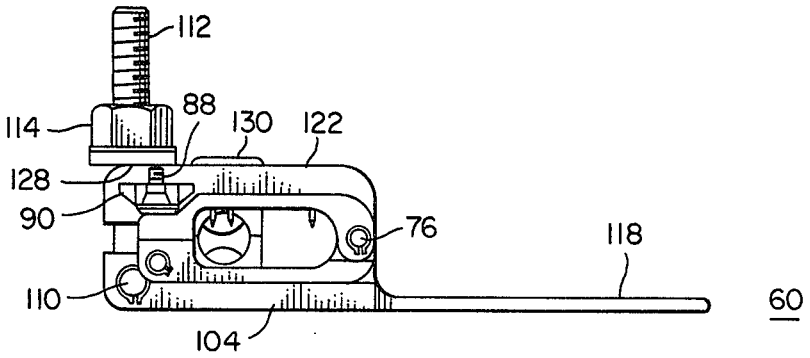
FIG. 1 is a side elevation of a tool constructed in accordance with the concepts of the invention.
Figure 2:
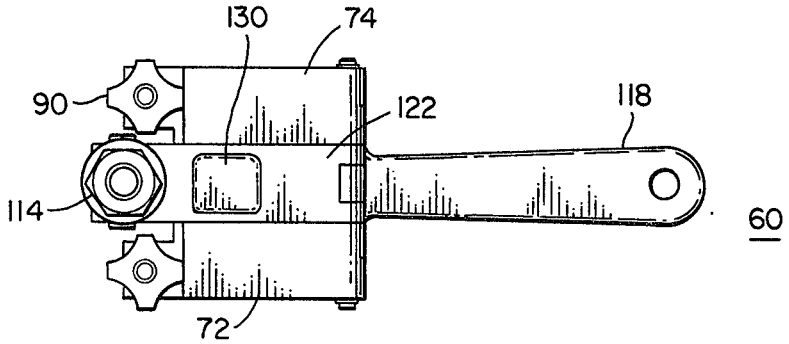
FIG. 2 is a top plan view of the tool of FIG. 1.
Figure 3:
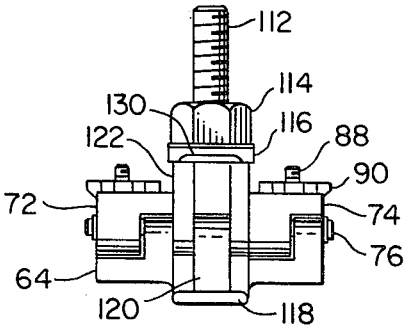
FIG. 3 is a rear elevation of the tool of FIG. 1.
Figure 4:
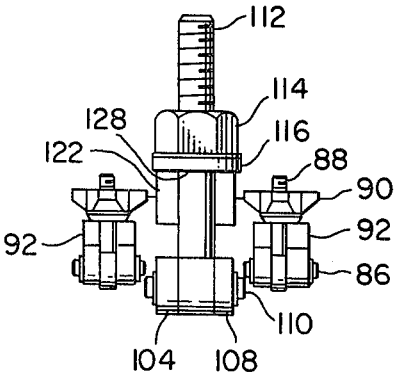
FIG. 4 is a front elevation of the tool of FIG. 1.
Figure 5:
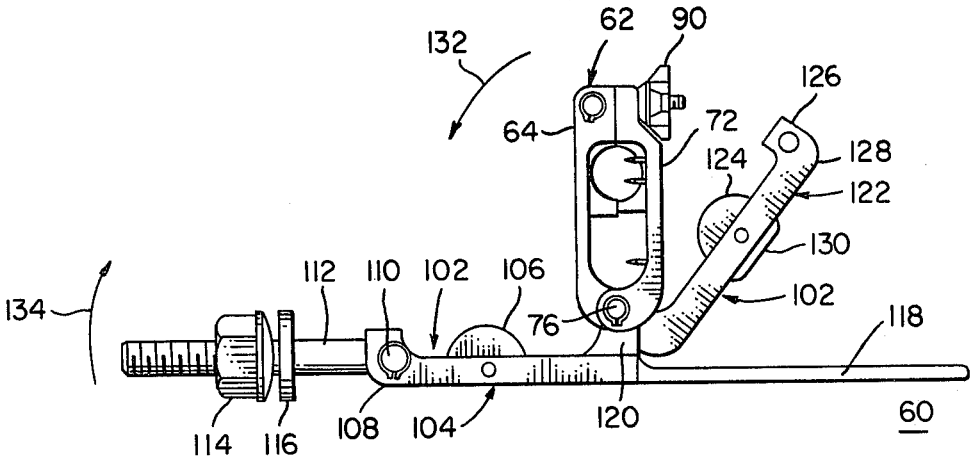
FIG. 5 is a side elevation of the tool of FIG. 1 partially open to show details of the structure.
Figure 6:
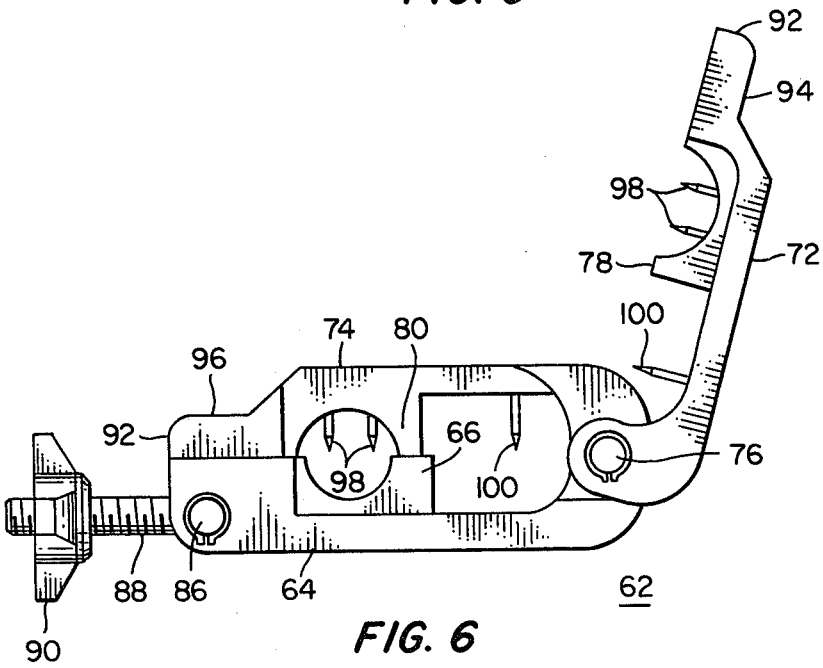
FIG. 6 is a side elevation of a portion of the tool of FIG. 1 partially open to show details thereof.
Figure 7:
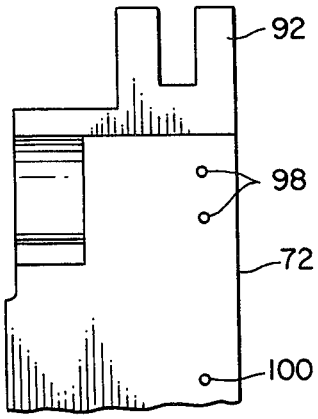
FIG. 7 is a fragmentary, bottom plan view of a portion of the tool of FIG. 1 to show details thereof.
Figure 8:
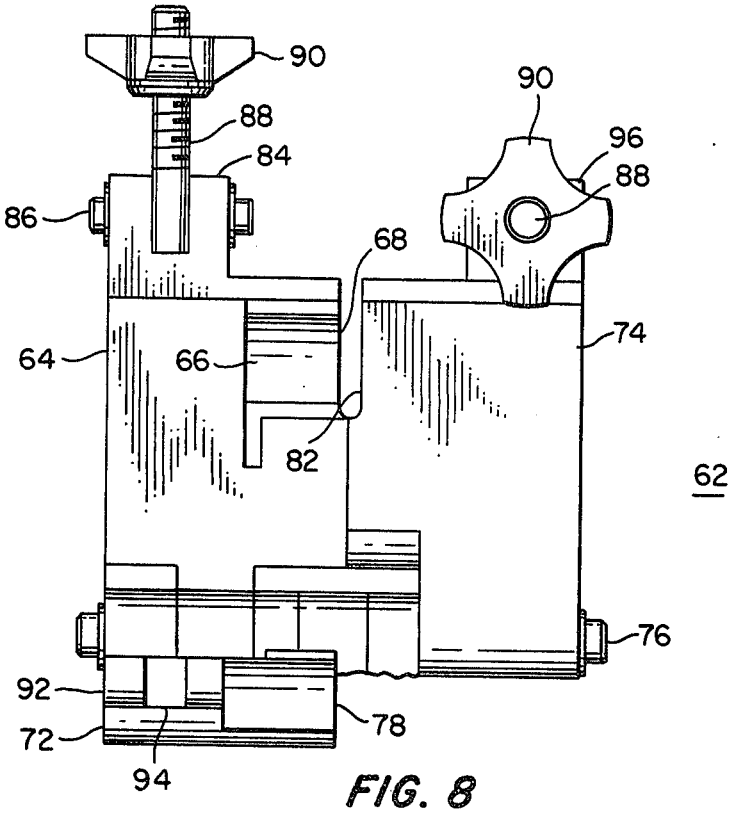
FIG. 8 is a top plan view of the tool portion of FIG. 6.

Crimping of the sleeve 28 to the bared ends 26, 46 of the conductors 24, 44 respectively is accomplished by the crimping subassembly 102 shown in FIG. 5. Crimping subassembly 102 is made up of a first member 104 having thereon a first indentor 106. At one end of member 104 a pair of extensions 108 project to which are pivotally joined, as by pin 110, a threaded stud 112 along which may be threadedly advanced a fastener 114 and a washer 116. A handle 118 projects from the opposite end of member 104 to stabilize the crimping subassembly 102, as will be described below. Crimping subassembly 102 is pivotally coupled to the gripping subassembly 62 by pin 76 which extends through projection 120. As the crimping subassembly 102 is pivoted about pin 76 the first indentor 106 can be selectively introduced through slot 68 in sleeve support 66 to the sleeve 28 resting thereon.

A second member 122 is also pivotally coupled to the gripping subassembly 62 by the pin 76. Second member 122 carries the second indentor 124 which can be selectively introduced through slot 82 between arms 72, 74 and sleeve supports 78, 80 to the sleeve 28 upon sleeve support 66. A pair of extensions 126 project from the member 122 and receive therebetween the threaded stud 112 of the first member 104. The washer 116 is permitted to bear against surface 128 of the second member 122 as the fastener 114 is threadedly advanced upon threaded stud 112. A striking pad 130 is placed upon the upper surface of the member 122 in alignment with the second indentor 124.

Figure 13:
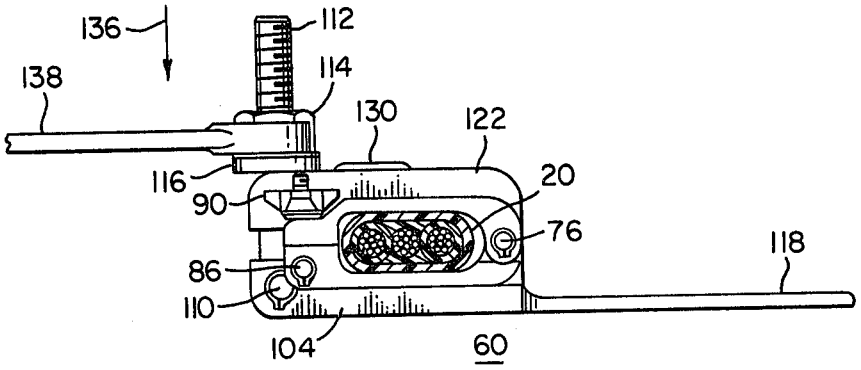
FIG. 13 is a reproduction of FIG. 1 with a cable therein and operated by a wrench.

To operate the crimping subassembly 102, the first member 104 is placed upon a solid surface and the gripping subassembly 62 is rotated counterclockwise, as shown by arrow 132 on FIG. 5, bringing the first indentor 106 into contact with the sleeve 28. Next, the second member 122 is rotated counterclockwise as shown by arrow 132 in FIG. 5 to bring the second indentor 124 into contact with sleeve 128. The crimping action may now be carried out by use of a wrench or by use of a hammer. If the wrench is to be employed as shown in FIG. 13, the threaded stud 112 is moved clockwise as shown by the arrow 134 in FIG. 5 and positioned between the extensions 126 of second member 122 with washer 116 resting on surface 128 of member 122. The fastener 114 is advanced downwardly along the threaded stud 112 in the direction of arrow 136 in FIG. 13 until fingertight. To complete the crimping, a wrench 138 is applied to the wrench flats of fastener 114 and turned forcing first and second members 104 and 122, respectively, toward one another and consequently forcing first and second indentors 106, 124 respectively into crimping engagement with sleeve 28. Handle 118 may be grasped by the operator or stood upon to stabilize the tool 60 and to keep same from turning as the wrench 138 is turned.

Figure 14:
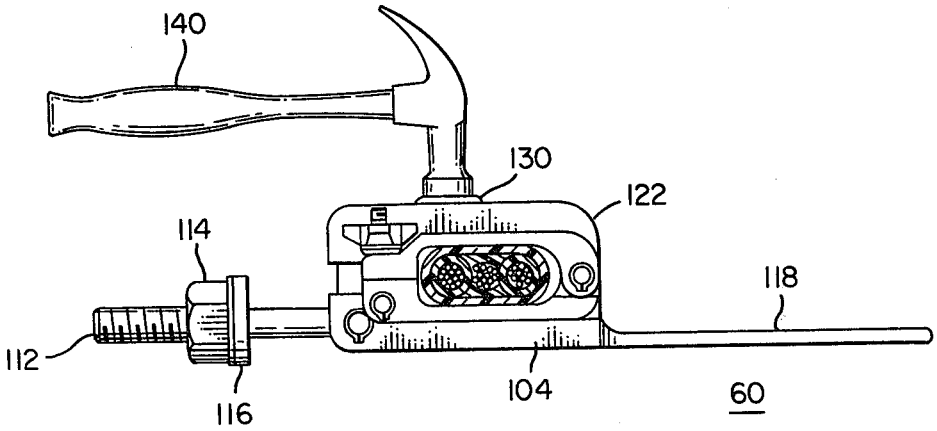
FIG. 14 is a reproduction of FIG. 1 with a cable therein and operated by being struck with a hammer.

Alternatively, if a hammer is to be used to complete the crimping step, as is shown in FIG. 14, the threaded stud 114 is allowed to remain disengaged and lie along the same surface as supports tool 60. A hammer 140 is then used to strike hammer pad 130 and force the first and second members 104, 122 respectively to move towards one another and consequently cause the first and second indentors 106, 124 respectively to crimp the sleeve 28. Handle 118 may again be held or stood on to stabilize or prevent tool 60 from turning or moving.

While there have been shown and described and pointed out the fundamental novel features of the invention as applied to the preferred embodiment, it will be understood that various omissions and substitutions and changes in the form and details of the device illustrated and in its operation may be made by those skilled in the art, without departing from the spirit of the invention.

The embodiments of the invention in which an exclusive property or privilege is claimed are defined as follows:

1. An installing tool for crimping a hollow sleeve upon two or more elongate conductors having insulation thereabout, the ends of said conductors being exposed, comprising: sleeve retention means to retain a hollow sleeve in a fixed position; conductor retention means adjacent said sleeve retention means and movably coupled thereto for engaging at least two conductors and retaining same within, and in a fixed position relative to, said hollow sleeve, said conductor retention means comprising a pair of selectively positionable, lockable arms, one of such arms to each side of said sleeve retention means, each of said arms having at least one spike thereon to engage the insulation of a conductor and retain such conductor in said conductor retention means with the exposed end thereof in said hollow sleeve when said arm is in a closed position and locked; and crimping means adjacent said sleeve retention means and selectively operable to crimp said hollow sleeve onto said conductors to form an electrical and mechanical joint therebetween.

2. An installing tool as defined in claim 1, wherein said crimping means comprises at least one indenting means mounted upon carrier means arranged to be struck to cause crimping engagement between said indenting means and said hollow sleeve to crimp said hollow sleeve to the conductors.

3. An installing tool as defined in claim 1, wherein said crimping means comprises at least one indenting means mounted upon carrier means; adjustable coupling means coupled to said sleeve retention means and said carrier means to cause crimping engagement between said indenting means and said hollow sleeve.

4. An installing tool as defined in claim 1, further comprising a base member; said sleeve retention means and said conductor retention means being pivotally coupled to said base member for selectively positioning a hollow sleeve with conductors therein adjacent said base member.

5. An installing tool as defined in claim 4, wherein said crimping means comprises a first indenting means on said base member and a second indenting means mounted upon carrier means pivotally coupled to said base member, said first and second indenting means crimping said hollow sleeve to the conductors inserted therein when said carrier means is struck.

6. An installing tool as defined in claim 4, wherein said crimping means comprises a first indenting means on said base member and a second indenting means mounted upon carrier means pivotally coupled to said base member; adjustable coupling means coupled to said base member and said carrier means to cause crimping engagement between said first and second indenting means and said hollow sleeve to crimp said hollow sleeve to the conductors.

7. An installing tool as defined in claim 4, further comprising handle means coupled to said base member.

8. An installing tool for crimping a hollow metallic sleeve upon two or more elongate conductors, the bared ends of which have been inserted into such sleeve comprising: a base plate having a first sleeve support thereon for receiving a hollow sleeve; first arm means, having a second sleeve support thereon, pivotally coupled to said base plate and positionable to a closed position to at least partially engage a hollow sleeve between said first and second sleeve supports; said first arm means further comprising first conductor retaining means to retain a first conductor with its bared end in the hollow sleeve positioned on said first sleeve support; second arm means, having a third sleeve support thereon, pivotally coupled to said base plate and positionable to a closed position to at least partially engage a hollow sleeve between said first and third sleeve supports; said second arm means further comprising second conductor retaining means to retain a second conductor with its bared end in the hollow sleeve positioned on said first sleeve support; and crimping means pivotally coupled to said base plate to crimp the hollow sleeve positioned on said first sleeve support to the bared ends of the conductors placed therein.

9. An installing tool as defined in claim 8, further comprising first latch means coupled to said base plate and engageable with said first arm means to latch same in a closed position and second latch means coupled to said base plate and engageable with said second arm means to latch same in a closed position.

10. An installing tool as defined in claim 8, wherein said crimping means comprises at least one indenting means mounted upon carrier means aranged to be struck to cause crimping engagement between said indenting means and said hollow sleeve to crimp said hollow sleeve to the conductor ends inserted therein.

11. An installing tool as defined in claim 8, wherein said crimping means comprises at least one indenting means mounted upon carrier means; adjustable coupling means coupled to said sleeve retention means and said carrier means to cause crimping engagement between said indenting means and said hollow sleeve.

12. An installing tool as defined in claim 8, wherein said crimping means comprises a first member pivotally coupled to said base plate and having thereon a first indenting means and a second member pivotally coupled to said base plate and having thereon a second indenting means, one of said first and second members being struck to cause said first and second indenting means to crimp a hollow sleeve placed on said first sleeve support to the bared ends of conductors placed therein.

13. An installing tool as defined in claim 12, further comprising a pad on said second member arranged to be struck and transmit the force applied to said first and second indenting means.

14. An installing tool as defined in claim 8, wherein said crimping means comprises a first member pivotally coupled to said base plate and having thereon a first indenting means; a second member pivotally coupled to said base plate and having thereon a second indenting means; threaded stud means coupled to said first member; and fastening means engaging said second member threadedly engaging said stud and advancing thereon to force said first and second indenting means toward one another to crimp a hollow sleeve placed on said first sleeve support to the bared ends of conductors placed therein.

15. An installing tool as defined in claim 12, further comprising handle means to coupled to said first member to permit said tool to be stabilized as it is used.

* * * * *